US007611371B2

(12) United States Patent
Guo

(10) Patent No.: US 7,611,371 B2
(45) Date of Patent: Nov. 3, 2009

(54) ELECTRONIC DEVICE WITH RECEPTACLE PROTECTOR

(75) Inventor: Shi-Kun Guo, Shenzhen (CN)

(73) Assignees: Hong Fu Jin Precision Industry (ShenZhen) Co., Ltd., Shenzhen, Guangdong Province (CN); Hon Hai Precision Industry Co., Ltd., Tu-Cheng, Taipei Hsien (TW)

( * ) Notice: Subject to any disclaimer, the term of this patent is extended or adjusted under 35 U.S.C. 154(b) by 0 days.

(21) Appl. No.: 12/136,775

(22) Filed: Jun. 11, 2008

(65) Prior Publication Data

US 2009/0130875 A1 May 21, 2009

(30) Foreign Application Priority Data

Nov. 16, 2007 (CN) ..... 2007 1 0202572

(51) Int. Cl.
*H01R 13/62* (2006.01)

(52) U.S. Cl. ..... 439/367

(58) Field of Classification Search ..... 439/367, 439/136, 139, 140, 147, 149
See application file for complete search history.

(56) References Cited

U.S. PATENT DOCUMENTS 4,479,688 A * 10/1984 Jennings ..... 200/43.02
5,186,636 A * 2/1993 Boyer et al. ..... 439/133
5,414,587 A * 5/1995 Kiser et al. ..... 361/118
6,338,644 B1 * 1/2002 Fritzinger et al. ..... 439/445
6,354,852 B2 * 3/2002 Noro et al. ..... 439/157
6,837,745 B2 * 1/2005 Takada et al. ..... 439/595
7,500,858 B2 * 3/2009 Emerson et al. ..... 439/136
7,500,866 B2 * 3/2009 Gennai et al. ..... 439/367
2002/0119697 A1 * 8/2002 Chan ..... 439/519
2004/0258336 A1 * 12/2004 Hou ..... 384/276
2005/0014408 A1 * 1/2005 Swiatek et al. ..... 439/215
2006/0154520 A1 * 7/2006 Gennai et al. ..... 439/578
2006/0154532 A1 * 7/2006 Yamada et al. ..... 439/701
2008/0026614 A1 * 1/2008 Emerson et al. ..... 439/136

* cited by examiner

*Primary Examiner*—Chandrika Prasad
(74) *Attorney, Agent, or Firm*—Frank R. Niranjan

(57) ABSTRACT

An electronic device (100) includes an enclosure (10), a receptacle (20) and a receptacle protector (30). The enclosure defines an opening (45) therein. The receptacle is disposed in the enclosure and faces the opening of the enclosure. The receptacle protector is used for protecting the receptacle. The receptacle protector includes a cap portion (32) covering the receptacle and a tongue (34) slidably connected with the enclosure.

14 Claims, 6 Drawing Sheets

ELECTRONIC DEVICE WITH RECEPTACLE PROTECTOR

BACKGROUND

1. Technical Field

The present invention generally relates to electronic devices, and particularly to a receptacle protector of an electronic device.

2. Description of Related Art

Hardware interfaces such as universal serial bus (USB) ports are often needed in electronic devices for connecting an electronic device to a portable storage device, a media player, or other electronic device to transfer data therebetween. A receptacle protector is needed for protecting the data interface when the data interface is not in use.

A conventional receptacle protector for the hardware interface is often a single piece that is detachable from the electronic device. When the hardware interface is not in use, the receptacle protector covers the hardware interface for protecting the hardware interface. When the hardware interface is in use, the receptacle protector is temporarily detached from the hardware interface. Because the receptacle protector is removed from the electronic device, the receptacle protector may be lost or misplaced resulting in the receptacle being unprotected when not in use.

What is needed, therefore, is an electronic device having a receptacle protector which is not susceptible to being lost or misplaced.

SUMMARY

The present invention relates to an electronic device having a receptacle protector for a receptacle which connects with the electronic device and can not be easily removed from the electronic device. According to an embodiment of the present invention, the electronic device includes an enclosure, a receptacle and a receptacle protector. The enclosure defines an opening therein. The receptacle is disposed in the enclosure and faces the opening of the enclosure. The receptacle protector is used for protection of the receptacle. The receptacle protector includes a cap portion covering the receptacle and a tongue slidably connected with the enclosure.

Other advantages and novel features of the present invention will become more apparent from the following detailed description of embodiments when taken in conjunction with the accompanying drawings.

DETAILED DESCRIPTION OF THE EMBODIMENTS

Figure 1:
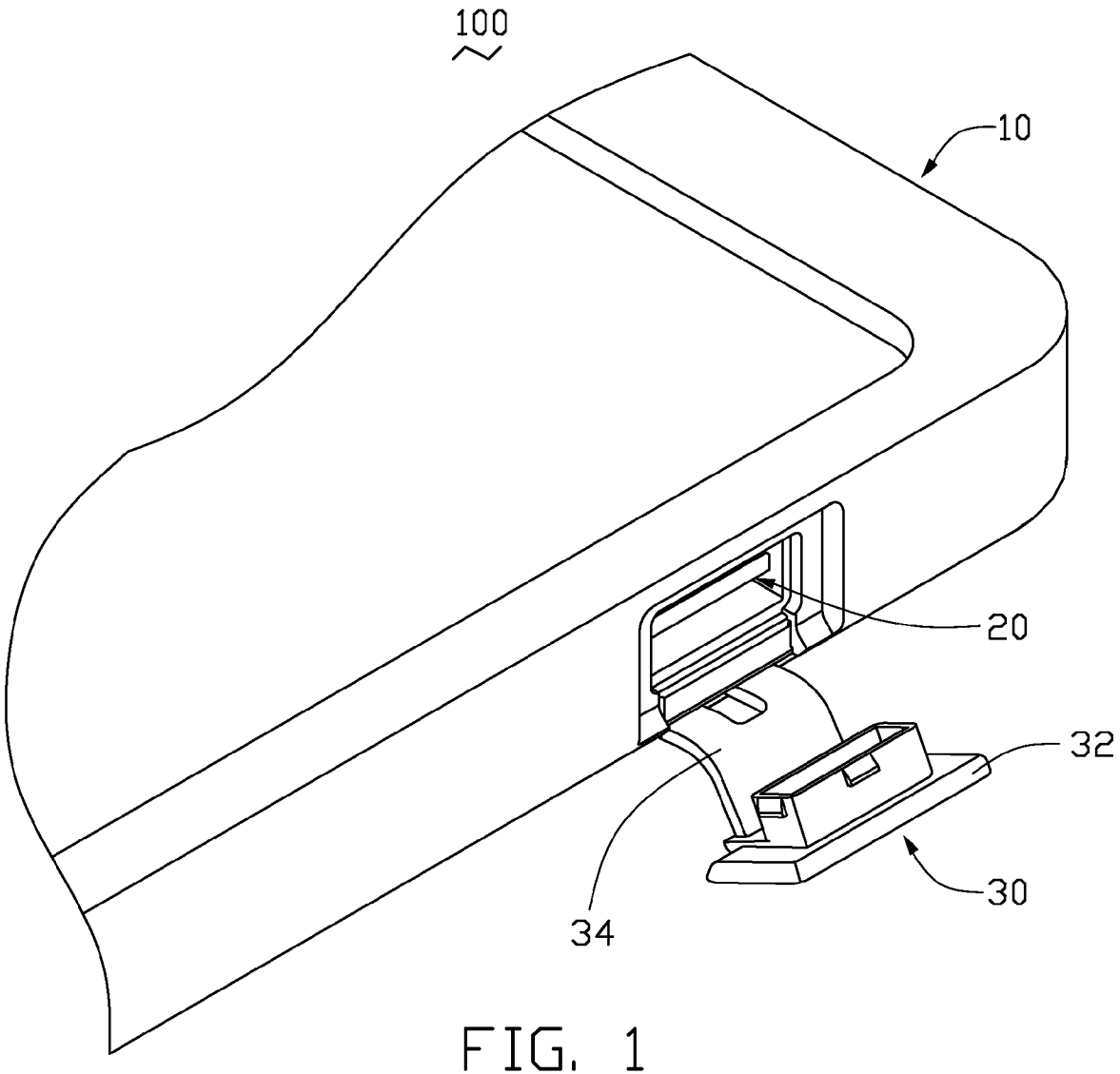
FIG. 1 an assembled, isometric view of an electronic device in accordance with a first embodiment of the present invention.

Reference will now be made to the drawing figures to describe the various present embodiments in detail.

Figure 2:
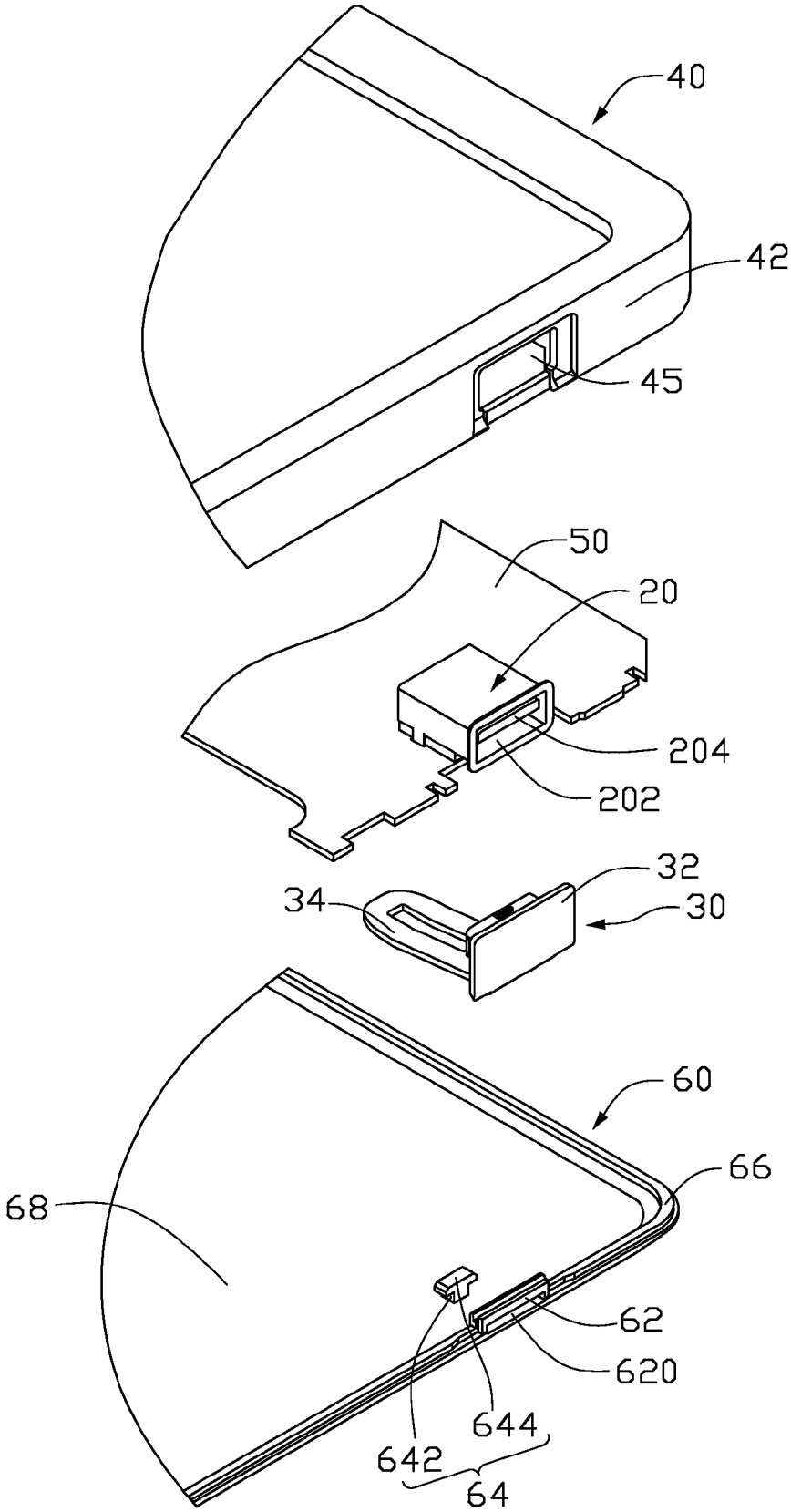
FIG. 2 is an exploded, isometric view of the electronic device of FIG. 1.

Referring to FIGS. 1 and 2, an electronic device 100 in accordance with an embodiment of the present invention is shown. The electronic device 100 includes an enclosure 10, a printed circuit board 50, a receptacle 20 and a receptacle protector 30. The enclosure 10 defines an opening 45 therein. The printed circuit board 50 is disposed in the enclosure 10. The receptacle 20 is located in the enclosure 10 and adjacent to the printed circuit board 50. A mating plug (not shown) of other electronic device, such as a music player, a data cable, or a mobile storage device, may be connected to the receptacle 20 through the opening 45 of the enclosure 10 so that the present electronic device 100 electrically connects with the other electronic device for facilitating data transfer. The receptacle protector 30 covers the opening 45 when the receptacle 20 is not in use.

The enclosure 10 includes a base plate 60 and a top lid 40 covering the base plate 60. The opening 45 is defined in a sidewall 42 of the top lid 40. The base plate 60 has a brim 66 upwardly and integrally extending from a periphery of the base plate 60. A T-shaped fixing portion 64 is firmly attached to a top surface 68 of the base plate 60. Alternatively, the fixing portion 64 may be integrally formed with the base plate 60 from a single piece. The fixing portion 64 includes a neck 642 vertically extending from the top surface 68 of the base plate 60 and a head 644 horizontally and integrally extending from a top extreme end of the neck 642. A rectangular guiding portion 62 is integrally formed on the brim 66 of the base plate 60 and located just below the receptacle 20. A rectangular opening 620 is defined in a middle portion of the guiding portion 62, facing the fixing portion 64.

The receptacle 20 is firmly fixed to and electrically connects with the printed circuit board 50. The receptacle 20 includes a rectangular container 202 defining a hollow center, and a pin 204 received inside the hollow center. The mating plug of the other electronic product is inserted into the hollow center of the receptacle 20 and electrically connects with the pin 204 of the receptacle 20. In this embodiment, the receptacle 20 is a hardware interface such as a universal serial bus (USB) receptacle, a secure digital (SD) card port, or a high definition multimedia interface (HDMI) port.

Figure 3:
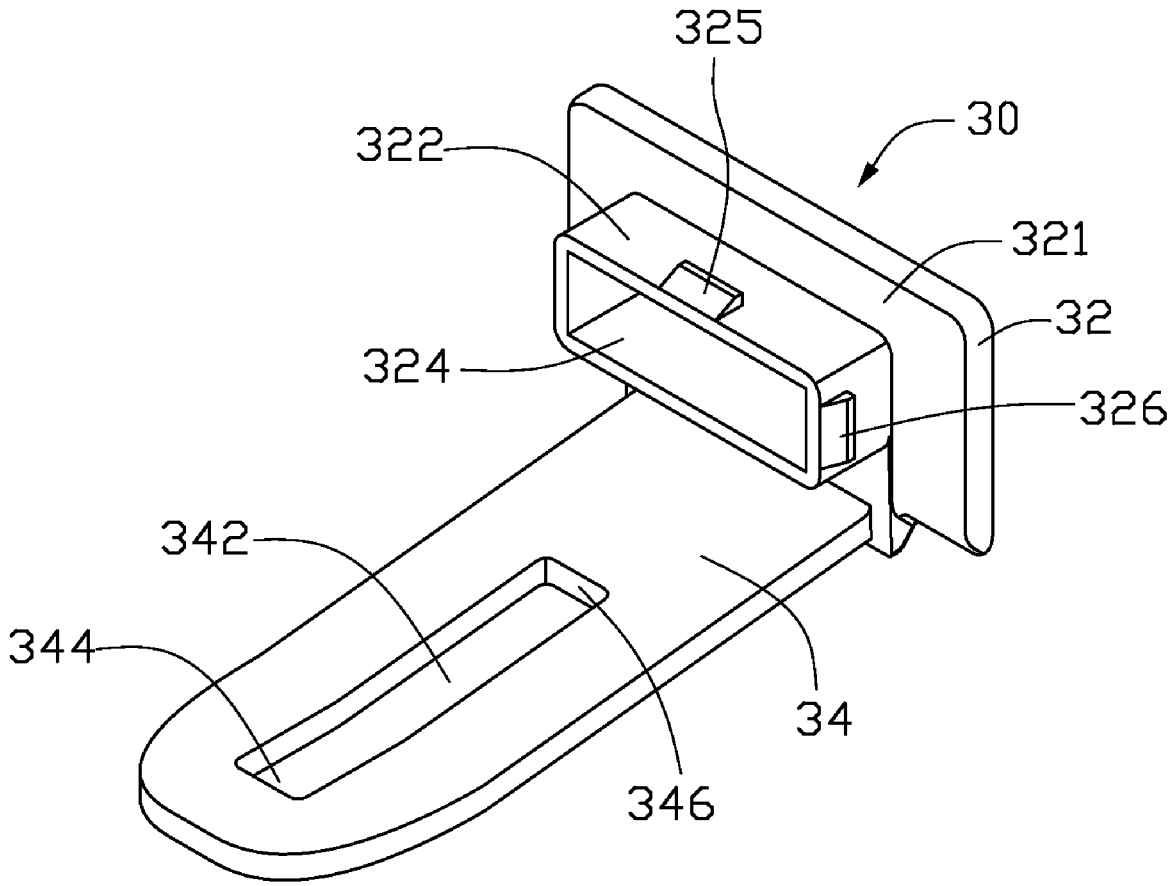
FIG. 3 is an isometric view of a receptacle protector of the electronic device of FIG. 1.
Figure 4:
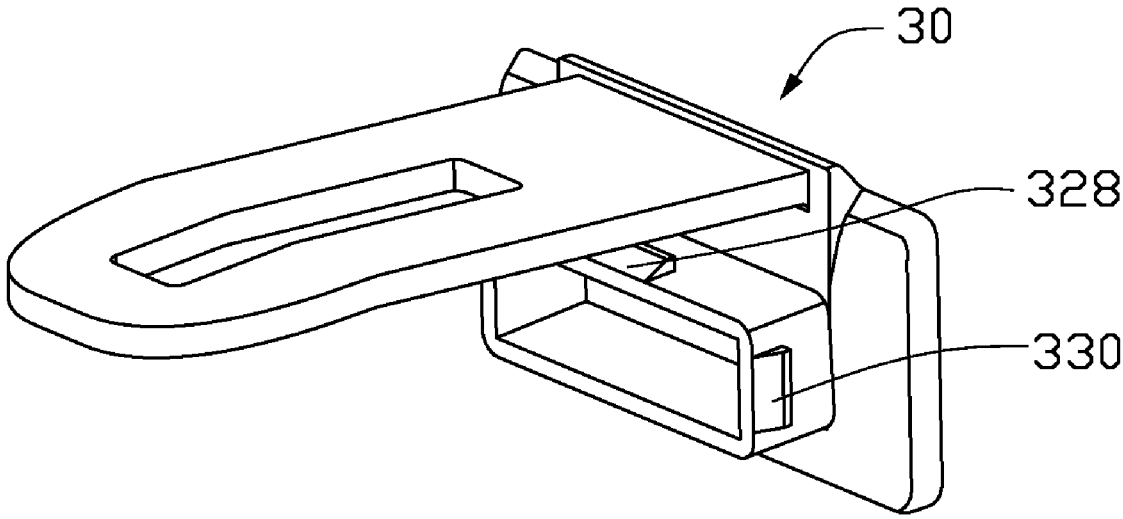
FIG. 4 is similar to FIG. 3, but viewed from a top-to-bottom aspect.

Referring to FIGS. 3 and 4, the receptacle protector 30 includes a rectangular cap portion 32, a rectangular flange 322 and a tongue 34 integrally formed with the cap portion 32. The flange 322 extends from an inner surface 321 of the cap portion 32 toward a space defined in the enclosure 10. A diameter of an outer periphery of the flange 322 is less than a diameter of an outer periphery of the cap portion 32. The flange 322 defines a rectangular recess corresponding to the pin 204 so that the pin 204 can be partially inserted into the flange 322. Four wedges 325, 326, 328, 330 extend outwardly at regular intervals around an outer surface of the flange 322. The tongue 34 extends from a bottommost edge of the flange 322 and extends from the left surface 321 of the cap portion 32 toward the space defined in the enclosure 10. The tongue 34 defines an elongate guide slot 342. A width of the guide slot 342 is equal to or greater than a width of the neck 642, but less than a width of the head 644 of the fixing portion 64. A first and a second abutting surfaces 344, 346 are correspondingly formed at opposite longitudinal ends of the guide slot 342.

The first abutting surface 344 is adjacent to a distal end from the cap portion 32, while the second abutting surface 346 is located adjacent to the cap portion 32.

The receptacle protector 30 is made of resilient material such as plastic or soft rubber, and integrally injected from by inject molding method. Therefore, the tongue 34 deforms elastically when the flange 322 and the cap portion 32 of the receptacle protector 30 are disengaged from the receptacle 20 and the cap portion 32 is pressed downwards when inserting the mating plug into the receptacle 20.

Figure 5:
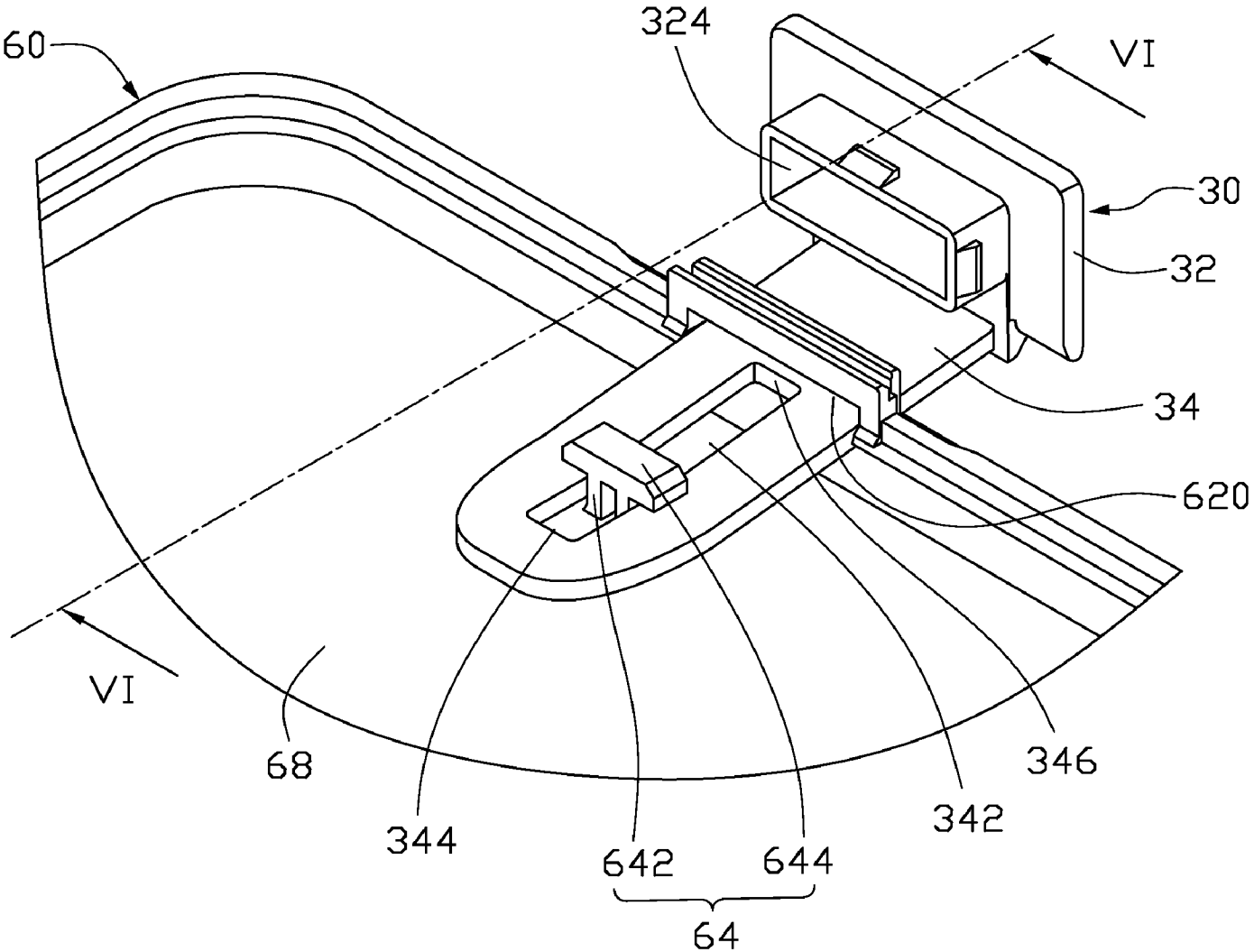
FIG. 5 is an assembled view of the receptacle protector and a base plate of the electronic device of FIG. 2.
Figure 6:
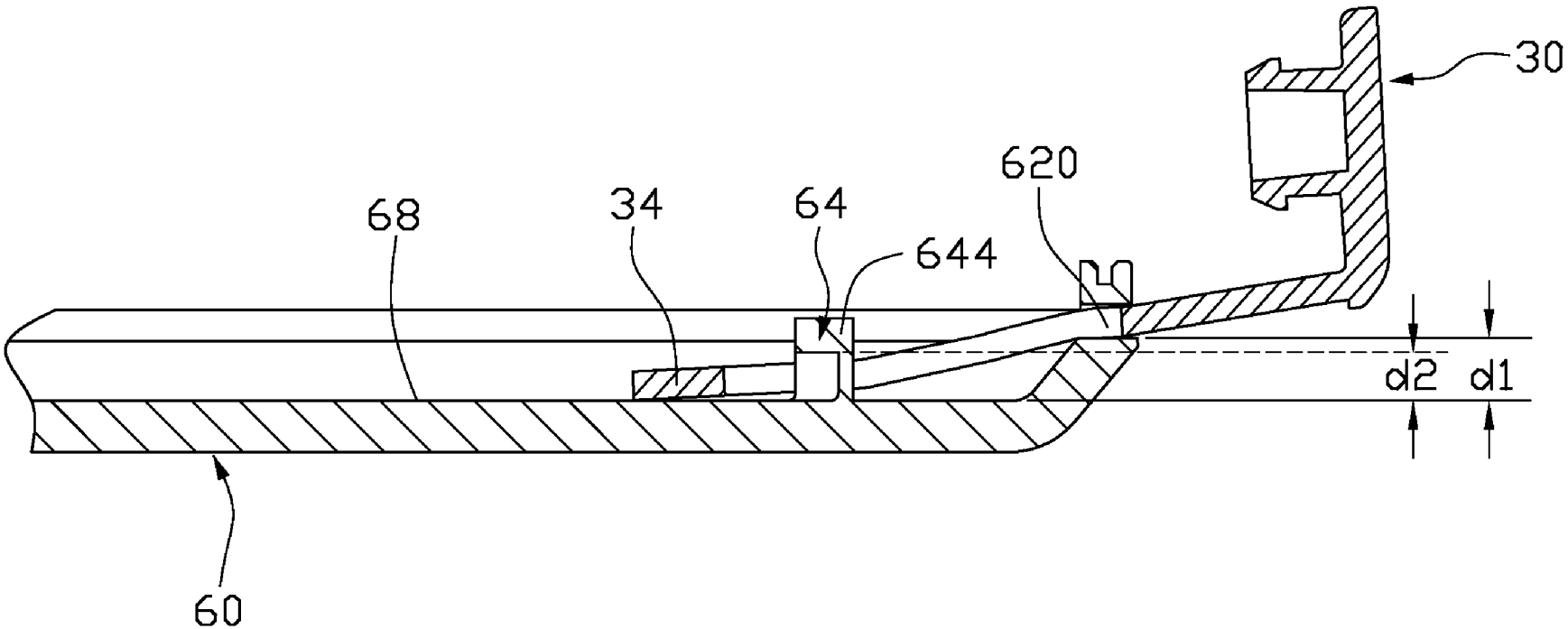
FIG. 6 is a cross sectional view of FIG. 5, taken along line VI-VI thereof.

Referring to FIGS. 5 and 6, during assembly of the receptacle protector 30 onto the enclosure 10, the tongue 34 of the receptacle protector 30 extends through the opening 620 of the base plate 60 of the enclosure 10. The tongue 34 of the receptacle protector 30 is forced to deform outwardly so that a width of the guide slot 342 is increased. Meanwhile, the tongue 34 of the receptacle protector 30 is pressed downwards until the head 644 of the fixing portion 64 extends through the guide slot 342 of the receptacle protector 30 and the neck 642 of the fixing portion 64 is received in the guide slot 342. Then, the deformation force is released, the tongue 34 of the receptacle protector 30 resiliently returns to its original position and the head 644 of the fixing portion 64 prevents the receptacle protector 30 from disengaging from the fixing portion 64. Therefore, the receptacle protector 30 is mounted to the enclosure 10 of the electronic device 100 and is movable left and right along the length of the tongue 34.

When the receptacle 20 is not in use, the cap portion 32 of the receptacle protector 30 is pushed to move toward the enclosure 10 and the tongue 34 slides toward the enclosure 10 along the guide slot 342 until the neck 642 of the fixing portion 64 of the enclosure 10 abuts against the second abutting surface 346 of the tongue 34. In this position, the cap portion 32 of the receptacle protector 30 is received in the opening 45 of the top lid 40 of the enclosure 10, with a right surface of the cap portion 32 being coplanar with a rightmost surface of the container 42 of the top lid 40 of the enclosure 10. Meanwhile, the wedges 325, 326, 328, 330 of the flange 322 and the cap portion 32 of the receptacle protector 30 abut against the container 202 of the receptacle 20 and the sidewalls surrounding the opening 45 of the enclosure 10, respectively. A distance dl between a bottommost surface surrounding the opening 620 and the top surface 68 of the base plate 60 is greater than a distance d2 between a bottommost surface of the head 644 and the top surface 68 of the base plate 60.

When the receptacle 20 is to be used, a pulling force is applied on the cap portion 32 of the receptacle protector 30 to pull the cap portion 32 and the flange 322, of the receptacle protector 30, out from the receptacle 20 and pull the tongue 34 of the receptacle protector 30 to slide along the guide slot 342 of the tongue 34 until the neck 642 of the fixing portion 64 abutting against the first abutting surface 344 of the tongue 34. Then, the cap portion 32 is pressed downwardly and the mating plug is inserted into the receptacle 20.

In the present electronic device 100, because the distance d1 between the bottommost surface surrounding the opening 620 and the top surface 68 of the base plate 60 is greater than the distance d2 between the bottommost surface of the head 644 and the top surface 68 of the base plate 60, when the receptacle protector 30 is pulled out of the opening 45 of the enclosure 10, a part of the tongue 34 exposed out of the enclosure 10 is slightly bent towards the top lid 40 of the enclosure 10. A top surface of the tongue 34 abuts against a topmost surface surrounding the opening 620 of the guiding portion 62, which prevents the receptacle protector 30 from sliding downwardly when the opening 45 of the enclosure 10 is turned to a side-to-down position.

It is to be understood, however, that even though numerous characteristics and advantages of the present invention have been set forth in the foregoing description, together with details of the structure and function of the embodiments, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electronic device comprising:

an enclosure which defines an opening therein;

a receptacle disposed in the enclosure and facing the opening of the enclosure; and a receptacle protector configured for protection of the receptacle, the receptacle protector comprising a cap portion received in the opening and covering the receptacle and a tongue slidably connected with the enclosure;

wherein the enclosure cooperates with the tongue to prevent the receptacle protector from detaching from the enclosure when the cap portion is removed from the opening;

wherein the tongue of the receptacle protector has a guide slot, the enclosure including a fixing portion received in the guide slot, the receptacle protector being slidable with respect to the fixing portion of the electronic device, the fixing portion hooks the tongue to prevent the receptacle protector detaching from the enclosure when the cap portion is removed from the opening.

2. The electronic device of claim 1, wherein the fixing portion has a neck received in the guide slot of the receptacle protector and a head disposed on the guide slot for preventing the tongue from disengaging from the fixing portion.

3. The electronic device of claim 2, wherein a width of the guide slot is equal to or greater than a width of the neck, but less than a length of the head of the fixing portion.

4. The electronic device of claim 1, wherein the receptacle protector includes a cap portion and a flange extending from the cap portion, the flange being received in a hollow center defined in the receptacle and the cap portion being received in the opening of the enclosure.

5. The electronic device of claim 4, wherein a plurality of wedges extending from the flange for abutting against a container surrounding the hollow center of the receptacle.

6. The electronic device of claim 2, wherein the enclosure has a guiding portion located below the opening, the guiding portion defining an opening therein, the tongue of the receptacle protector slidably passing through the opening of the guiding portion.

7. The electronic device of claim 6, wherein the enclosure includes a base plate and a top lid covering the base plate, the fixing portion being attached to the base plate, a distance between a bottommost surface surrounding the opening and a top surface of the base plate being greater than a distance between a bottommost surface of the head and the top surface of the base plate.

8. The electronic device of claim 1, wherein the enclosure has a guiding portion located below the opening, the guiding portion defining an opening therein, the tongue of the receptacle protector slidably passing through the opening of the guiding portion.

9. The electronic device of claim 1, wherein the material of the receptacle protector is selected from plastic and soft rubber.

10. An electronic device comprising:

an enclosure with an opening and a fixing portion;

a receptacle disposed in the enclosure and exposed to the outside; and a receptacle protector having a cap portion covering the opening and a tongue connected with the cap portion;

wherein the tongue defines a guide slot surrounding the fixing portion preventing the receptacle protector detaching from the enclosure when the cap portion is out of the opening;

wherein the fixing portion has a neck received in the guide slot of the receptacle protector and a head extended from the neck preventing the tongue from disengaging from the fixing portion;

wherein a width of the guide slot is equal to or greater than a width of the neck, but less than a length the head of the fixing portion.

11. The electronic device according to claim 10, wherein the electronic also comprises a guiding portion with a guide opening, the tongue passes through the guide opening and surrounds the fixing portion, and a distance d1 between the bottommost surface of the neck and the bottommost surface surrounding the guide opening is greater than a distance d2 between the bottommost surface of the neck and the bottommost surface of the head.

12. The electronic device of claim 10, wherein the receptacle protector comprises a flange extending from the cap portion, the flange being received in a hollow center defined in the receptacle when the cap portion covers the opening.

13. An electronic device comprising:

an enclosure defining an opening, the enclosure comprising a fixing portion adjacent the opening;

a covering member fastened to the enclosure, the covering member comprising a cap portion detachably attachable to the enclosure for covering the opening and a connecting portion perpendicularly extending from the cap portion, wherein the fixing portion cooperates with the connecting portion to fix the connecting portion to the enclosure and allow the connecting portion to be movable from a first position to a second position, at the first position, the connecting portion is fully received in the enclosure, and at the second position, the connecting portion is partly moved out of the enclosure;

wherein the connecting portion defines a guiding slot, the fixing portion is installed to be limited in the guiding slot, the fixing portion has a neck received in the guiding slot and a head horizontally and integrally extending from an end of the neck;

wherein the electronic further comprises a guiding portion formed on the enclosure with a guide opening, the connecting portion passes through the guide opening to cooperate with the fixing portion, and a distance d1 between the bottommost surface of the neck and the bottommost surface surrounding the guide opening is greater than a distance d2 between the bottommost surface of the neck and the bottommost surface of the head.

14. The electronic device according to claim 13, further comprising a receptacle received in the enclosure facing the opening, the covering member further comprising a flange extending from the cap portion, the flange being received in a hollow center defined in the receptacle when the cap portion covers the opening.

* * * * *